US006059597A

United States Patent [19]

Endo et al.

[11] Patent Number: 6,059,597

[45] Date of Patent: May 9, 2000

[54] HALF-FITTING PREVENTION CONNECTOR

[75] Inventors: Takayoshi Endo; Takashi Ishii; Toshiharu Kudo; Tsuyoshi Hamai, all of Shizuoka, Japan

[73] Assignee: Yazaki Corporation, Tokyo, Japan

[21] Appl. No.: 08/771,683

[22] Filed: Dec. 23, 1996

[30] Foreign Application Priority Data

Dec. 28, 1995 [JP] Japan ..... 7-343864

[51] Int. Cl.[7] ..... H01R 13/627

[52] U.S. Cl. ..... 439/352

[58] Field of Search ..... 439/350–357, 439/310

[56] References Cited

U.S. PATENT DOCUMENTS

| | | | |
|---|---|---|---|
| 5,178,552 | 1/1993 | Jinno et al. | 439/140 |
| 5,217,385 | 6/1993 | Inoue et al. | 439/353 |
| 5,370,543 | 12/1994 | Hamada et al. | 439/352 |
| 5,376,014 | 12/1994 | Sumida | 439/352 |
| 5,573,417 | 11/1996 | Hashizawa et al. | 439/352 |

FOREIGN PATENT DOCUMENTS

| | | |
|---|---|---|
| 0 097 089 | 12/1983 | European Pat. Off. . |
| 0 416 304 A1 | 3/1991 | European Pat. Off. . |

*Primary Examiner*—Hien Vu

*Attorney, Agent, or Firm*—Sughrue, Mion, Zinn, Macpeak & Seas, PLLC

[57] ABSTRACT

A housing 3 of a female connector 1 has a receiving space 5 for a slide lock member 15 and a resilient member 17, and this receiving space 5 is provided near to a terminal receiving chamber 7 for receiving a connection terminal. The slide lock member 15 is slidable in a fitting direction, and retains a mating connector, and has a release projection 16 which is pressed when releasing the fitting. The receiving space 5 has an opening 6 through which part of the slide lock member 15 is exposed to the exterior. Half-fitting prevention lock stoppers 8 for limiting the movement of the mating connector are formed respectively at opposed sides of the receiving space 5.

8 Claims, 4 Drawing Sheets

HALF-FITTING PREVENTION CONNECTOR

BACKGROUND OF THE INVENTION

1. Field of the Invention

This invention relates to a half-fitting prevention connector in which a pair of male and female connectors, when left in a half-fitted condition, the fitting between the two connectors is released by the resiliency or bias of a resilient member, and the male and female connectors, when completely fitted together, are positively locked relative to each other.

2. Related art

Various half-fitting prevention connectors are known. One such conventional half-fitting prevention connector is disclosed, for example, in Japanese Utility Model Unexamined Publication No. 5-81967.

As shown in FIG. 6, a pin-type connector 50 has a plurality of pin contacts 52 arranged therein, and has a pair of mounting flanges 50*a* formed respectively at opposite sides thereof. A socket-type connector 51 has a plurality of socket contacts 53 arranged therein, and wires 53*a* are connected to the socket contacts 53, respectively.

The pin-type connector 50 includes a box-shaped housing 54 having an open front side, and a guide plate 55 for guiding the fitting of the socket-type connector 51 is mounted centrally of the height within the housing 54, and divides the interior of the housing 54 into an upper portion and a lower portion. As shown in FIG. 7, within the housing 54, the pin contacts 52 extend from a rear portion toward the front side of this housing. A notch is formed in a central portion of each of opposite side plates 54*a*, and a forwardly-directed engagement piece portion 56 is formed integrally with the side plate 54*a*, and is disposed in the notch. A distal end of the engagement piece portion 56 terminates short of the front edge of the side plate 54*a*, and can be slightly flexed outwardly. An inwardly-directed engagement projection 56*a* is formed on the distal end of the engagement piece portion 56.

The socket-type connector 51 includes a box-shaped housing 57, and has such a size as to be fitted into the opening in the housing 54 of the pin-type connector 50. Pin holes 58 for respectively receiving the pin contacts 52, and a slot 59 for receiving the guide plate 55 is provided in the front side of the housing 57.

A movable cover 60 is movably fitted on the housing 57, and covers the housing 57 except front and rear end portions thereof. An opening 61 for receiving the pin-type connector 50 is formed in the front side of the movable cover 60. The opening 61 has such a size as to receive the opposite side plates 54*a*, a top plate 54*b* and a bottom plate 54*c* of the housing 54, but the distal ends of the engagement piece portions 56 can abut against the edge of the opening 61, thereby preventing the housing 54 from being inserted into the opening 61.

A pair of spring receiving portions (not shown) are formed respectively at opposite side portions of the movable cover 60 and hence at opposite side portions of the housing 57, and springs 64 are received respectively in the spring receiving portions as indicated in broken lines in FIG. 6, each of the springs 64 extending in the forward-backward direction. The movable cover 60 is normally urged forward (that is, left in FIG. 6) by the springs 64, and is retained by slots 65, formed through an upper wall of the movable cover 60, and projections 66 formed on the upper surface of the housing 57. An engagement groove 67 is formed in each of the opposite sides of the housing 57, and the engagement projection 56*a* of the engagement piece portion 56 is engaged in the associated engagement groove 67 when the two connectors are completely connected together. The engagement grooves 67 are normally concealed by the movable cover 60, and appear when the movable cover 60 is moved.

When the two connectors 50 and 51 are fitted together, the pin contacts 52 contact the socket contacts 53, respectively, and the engagement projections 56*a* are engaged respectively in the engagement grooves 67, as shown in FIG. 7. In this fitted condition, the springs 64 are compressed, and the engagement piece portions 56 are covered by the movable cover 60, so that the engagement projections 56*a* can not be disengaged respectively from the engagement grooves 67, thereby positively maintaining the connected condition.

On the other hand, when the completely-fitted condition is not achieved, that is, a half-fitted condition is encountered, the distal ends of the engagement piece portions 56 abut against the edge of the opening in the movable cover 60, and the springs 64 are compressed. Therefore, the movable cover 60 presses the engagement piece portions 56 under the influence of the springs 64, and therefore the two connectors 50 and 51 are urged away from each other, and can not be fitted together at all.

In the above connector, the half-fitting can be prevented. However, when the two connectors are to be fitted together while holding the opposite side surfaces of the movable cover 60 with the hand, the movable cover 60 fails to be moved, so that the fitting operation can not be achieved. And besides, the engagement piece portions 56 are not covered by the housing 57 in the completely-fitted condition, and therefore there has been encountered a problem that when an external force acts on the movable cover 60, the movable cover 60 can be easily moved, so that the fitted condition of the connectors can be accidentally released.

SUMMARY OF THE INVENTION

With the above problems in view, it is an object of this invention to provide a half-fitting prevention connector in which a pair of connectors can be easily fitted together, and can not be easily disengaged from each other upon application of an external force.

Means for solving the Problems

The above object of the invention has been achieved by a half-fitting prevention connector recited as follows:

A half-fitting prevention connector wherein a pair of female and male connectors are fitted and connected together, and resiliency of a resilient member, received in a housing of one of the two connectors, prevents the two connectors from being maintained in a half-fitted condition, wherein a lock member is received in the housing for sliding movement in a fitting direction, and retains the mating connector in the housing under the influence of the resilient member; and there is provided a support mechanism for slidably supporting the lock member in the housing.

A half-fitting prevention connector according to the present invention, in which the housing has a receiving space for receiving a slide lock member and the resilient member, and the receiving space is disposed near to a terminal receiving chamber for receiving a connection terminal, and the slide lock member is slidable in the fitting direction, and retains the mating connector, and, the receiving space has an opening through which part of the slide lock member is exposed to the exterior.

A half-fitting prevention connector according to the present invention, in which the slide lock member has a release projection which is pressed when releasing the fitting between the two connectors.

A half-fitting prevention connector according to the present invention, in which a housing of the mating connector includes an elastic lock arm, and a housing lock for being retained by the slide lock member is formed on an upper surface of the lock arm, and half-fitting prevention locks are formed on and projecting from on opposite sides of the lock arm, respectively, and the housing has half-fitting prevention lock stoppers formed at a front end portion of the receiving space.

A half-fitting prevention connector according to the present invention, in which the flexing of the lock arm during the fitting between the two connectors is limited by the half-fitting prevention locks and the half-fitting prevention lock stoppers.

In the half-fitting prevention connector of the above construction, during the connector fitting operation, the housing lock pushes the slide lock member in the fitting direction against the bias of the resilient member, and when the half-fitting prevention locks pass respectively past the half-fitting prevention lock stoppers, the resiliency of the resilient member becomes greater than the connector-inserting force, and the lock arm is flexed, so that the slide lock member is returned to its initial position under the influence of the resilient member, thus achieving the completely-fitted condition.

Therefore, if the connector is unhanded before the half-fitting prevention locks of the lock arm pass respectively past the half-fitting prevention lock stoppers, the female and male connectors are moved away from each other by the resiliency of the resilient member, thereby preventing a half-fitting condition. The slide lock is covered with the female housing when the two connectors are to be fitted together, and therefore the fitting operation can be carried out while holding the side walls of the female housing with the hand.

The flexing of the lock arm in a connector half-fitted condition is positively prevented by the half-fitting prevention locks and the half-fitting prevention lock stoppers, and the lock arm can be flexed only in the connector completely-fitted condition, thus positively preventing the half-fitting of the connector.

In the completely-fitted condition, the slide lock member retains the housing lock, and the slide lock is covered with the female housing, and therefore is less liable to receive an influence of an external force.

For releasing the fitting between the two connectors, the lock arm is pressed, and in this condition the lock arm is moved in the fitting direction while holding the release projection by the finger, so that the male housing can be easily disconnected.

DETAILED DESCRIPTION OF THE PREFERRED EMBODIMENTS

Figure 1:
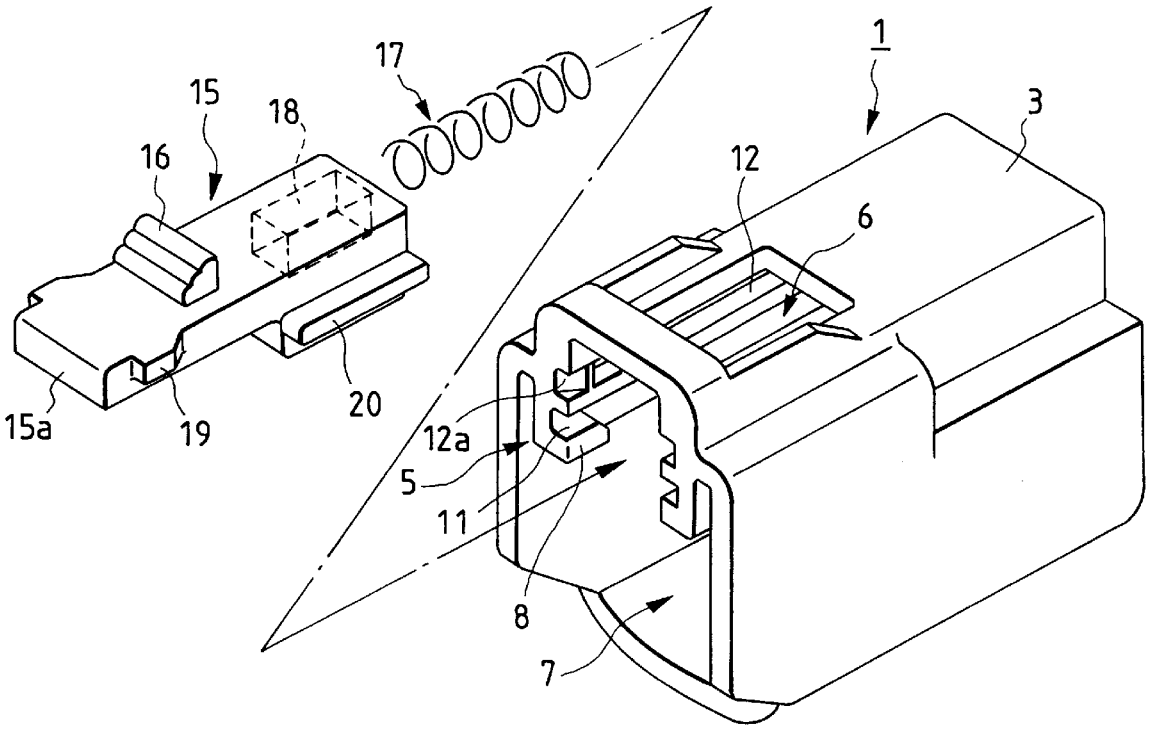
FIG. 1 is an exploded, perspective view showing a female connector of a half-fitting prevention connector of the present invention, having a lock member.
Figure 2:
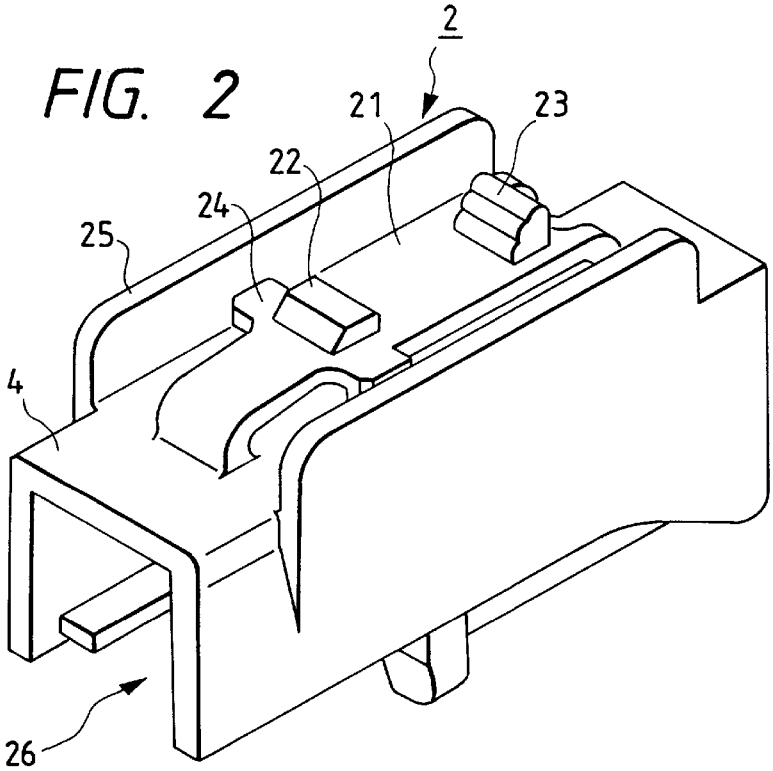
FIG. 2 is a perspective view showing a male connector of the half-fitting prevention connector of the invention.
Figure 3:
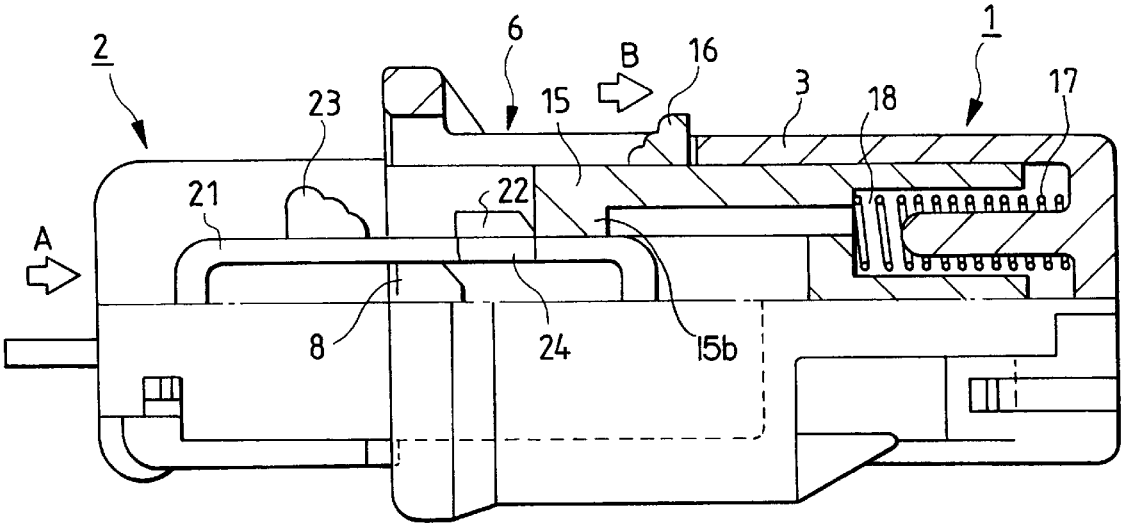
FIG. 3 is a view showing a condition during an operation of fitting between the female and male connectors.
Figure 4:
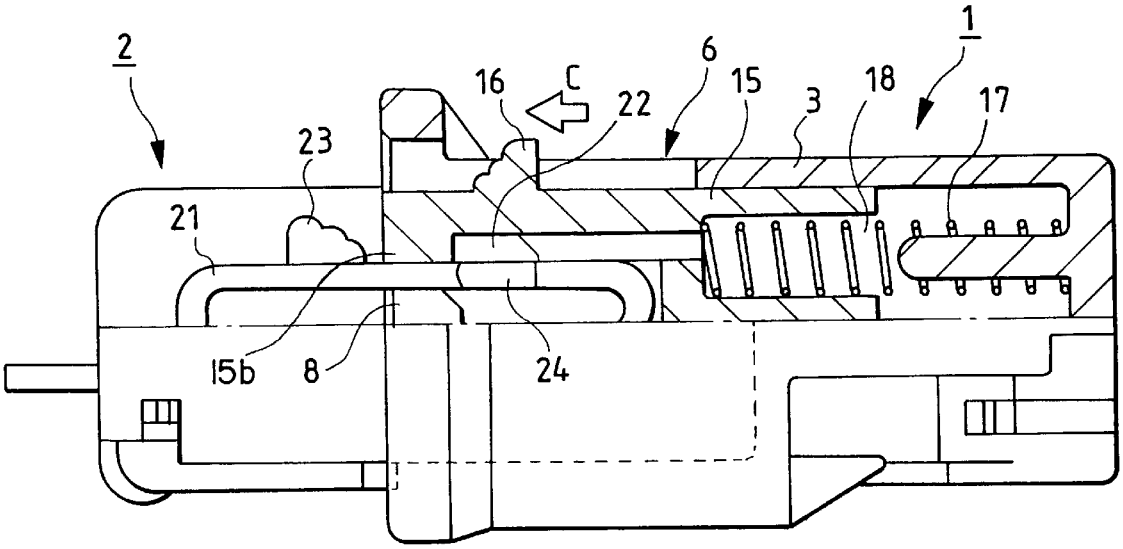
FIG. 4 is a view showing a condition in which the fitting operation of FIG. 3 is completed.
Figure 5:
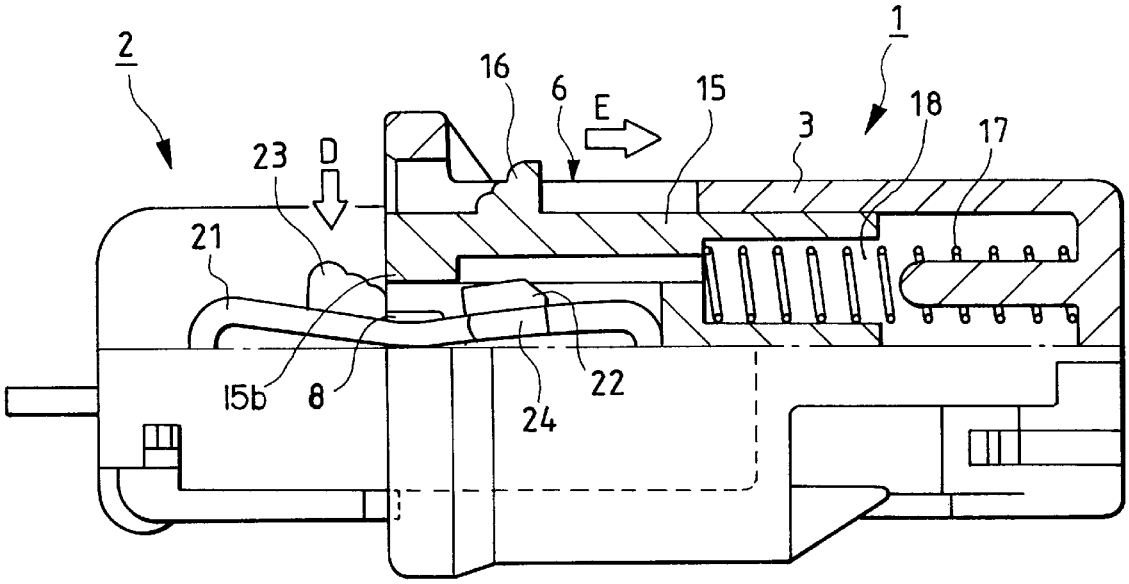
FIG. 5 is a view showing an operation of releasing the fitting condition of FIG. 4.
Figure 7:
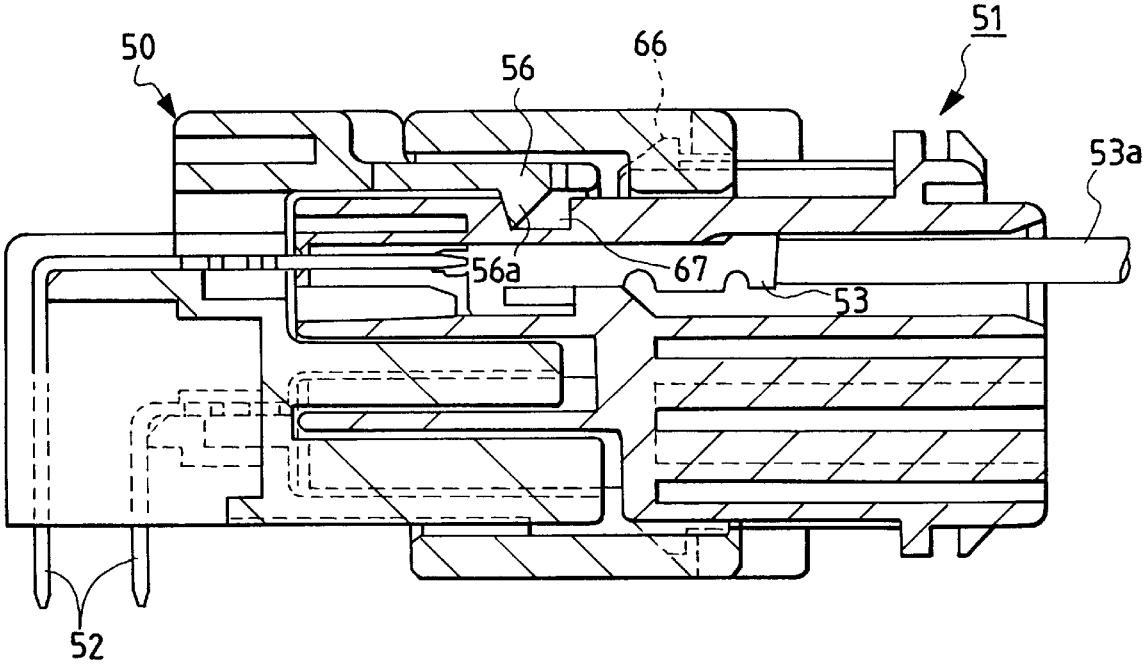
FIG. 7 is a vertical cross-sectional view showing the connector in a fitted condition.
Figure 6:
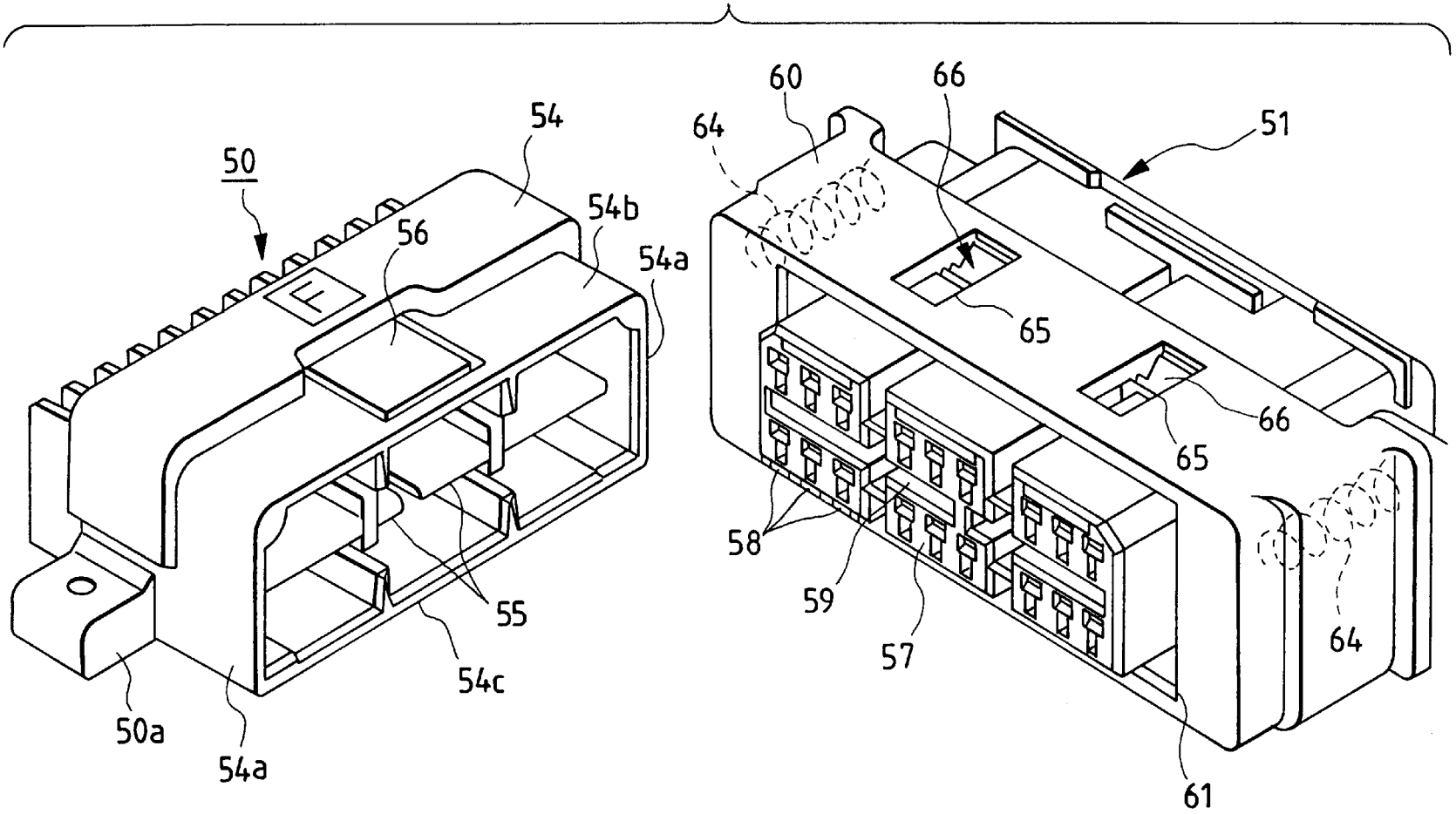
FIG. 6 is a perspective view showing the construction of a conventional connector.

A preferred embodiment of a half-fitting prevention connector of the present invention will now be described in detail with reference to FIGS. 1 to 5. FIG. 1 is an exploded, perspective view showing a female connector of the half-fitting prevention connector of the invention, having a lock member, FIG. 2 is a perspective view showing a male connector of the half-fitting prevention connector of the invention, FIG. 3 is a view showing a condition during an operation of fitting between the female and male connectors, FIG. 4 is a view showing a condition in which the fitting operation of FIG. 3 is completed, and FIG. 5 is a view showing an operation of releasing the fitting condition of FIG. 4.

In the female half-fitting prevention connector 1 shown in FIG. 1, a terminal receiving chamber 7 for receiving and holding a connection terminal is provided at a lower portion of an internal space of a housing 3, and a receiving space 5 for receiving and holding the slide lock member 15 is provided at an upper portion of the internal space of the housing 3. A pair of guide grooves 11 and 12, serving as an support mechanism, are formed in each of opposed side surfaces of the receiving space 5. A slide lock retaining portion 12*a* for preventing withdrawal of the slide lock member 15 is provided at a front end portion of the upper guide groove 12, this retaining portion 12*a* having an inclined surface for facilitating the insertion of the slide lock member 15 in a fitting direction. A half-fitting prevention lock stopper 8 is provided at a front end portion of the lower guide groove 11. An opening 6 is formed through an upper wall of the housing 3, and this opening 6 forms an upper portion of the receiving space 5.

The slide lock member 15 has a release projection 16 formed on an upper surface thereof, and a pair of slide stoppers 19 which are formed respectively on opposite sides of the slide lock member 15, and are disposed near to the release projection 16. The slide stoppers 19 are received respectively into the upper guide grooves 12 in the housing 3. A spring receiving chamber 18 for receiving a compression spring (resilient member) 17 is formed in a rear end portion of the slide lock member 15, and a pair of support projections 20 for being received respectively in the lower guide grooves 11 are formed respectively on the opposite sides of the slide lock member 15, and are disposed near to the spring receiving chamber 18.

A terminal receiving chamber 26 for receiving and holding a connection terminal is formed in a male housing 4 of the male connector 2. An elastic lock arm 21 is formed on an upper surface of the housing 4, and a pair of upstanding guide side walls 25 are formed respectively on opposite side walls of the housing 4.

A housing lock 22 for retaining engagement with the slide lock member 15 is formed on an upper surface of the lock arm 21, and a pair of half-fitting prevention locks 24 are formed respectively on opposite side edges of the lock arm 21, and are disposed near to the housing lock 22. A lock release projection 23 is formed-on the-upper surface of the lock arm 21 at a rear end portion thereof, and this lock release projection 23 is pressed or depressed when releasing the fitting.

In the above half-fitting prevention connector of this embodiment, first, the compression spring 17 is inserted into the spring receiving chamber 18 in the slide lock member 15, and in this condition the slide lock member 15 is inserted into the housing 3 as shown in FIG. 1, with the slide stoppers 19 received respectively in the upper guide grooves 12 and also with the support projections 20 received respectively in the lower guide grooves 11.

Then, the female connector 1 and the male connector 2 are fitted together as shown in FIG. 3. More specifically, when the male connector 2 is pushed into the female connector 1 in a direction of arrow A, a front end of the housing lock 22 on the lock arm 21 is abutted against a press end surface 15*a* of the slide lock member 15 to move the slide lock member 15 in a direction of arrow B, and the half fitting prevention locks 24 are disposed respectively above the half-fitting prevention lock stoppers 8.

In this condition, even if the lock arm 21 intends to be flexed downward, it can not be flexed since the half-fitting prevention locks 24 are abutted respectively against the upper surfaces of the half-fitting prevention lock stoppers 8.

In this condition, when the male connector 2 is further inserted against the bias of the compression spring 17, the half-fitting prevention locks 24 pass respectively past the half-fitting prevention lock stoppers 8, and are fitted respectively in the lower guide grooves 11, and also under the influence (resiliency) of the compression spring 17, the press end surface 15*a* of the slide lock member 15 slides past a slanting surface of the housing lock 22 while flexing the lock arm 21 downwardly.

Therefore, the slide lock member 15 is returned in a direction of arrow C as shown in FIG. 4, so that the housing lock 22 is retainingly engaged with the lower projecting portion (or locking projection 15*b*) of the slide lock member 15, thus completely the fitting between the female connector 1 and the male connector 2.

For releasing the fitting between the female connector 1 and the male connector 2, the lock release projection 23 on the lock arm 21 is pressed in a direction of arrow D (FIG. 5) to be flexed downward, thereby releasing the retained condition of the housing lock 22. Then, in this pressed condition, the slide lock member 15 is pulled in a direction of arrow E, so that the press end surface 15*a* of the slide lock member 15 slides past the housing lock 22 of the male connector 2, and the lock arm 21 is restored into its original configuration because of its elasticity, and the male connector 2 can be easily disengaged from the female connector 1.

In the above half-fitting prevention connector of the present invention, during the connector fitting operation, the housing lock pushes the slide lock member in the fitting direction against the bias of the resilient member, and when the half-fitting prevention locks pass respectively past the half-fitting prevention lock stoppers, the resiliency of the resilient member becomes greater than the connector-inserting force, and the lock arm is flexed, so that the slide lock member is returned to its initial position under the influence of the resilient member, thus achieving the completely-fitted condition.

Therefore, if the connector is unhanded before the half-fitting prevention locks of the lock arm pass respectively past the half-fitting prevention lock stoppers, the female and male connectors are moved away from each other by the resiliency of the resilient member, thereby preventing a half-fitting condition. The slide lock is covered with the female housing when the two connectors are to be fitted together, and therefore the fitting operation can be carried out while holding the side walls of the female housing with the hand.

In the completely-fitted condition, the slide lock member retains the housing lock, and the slide lock is covered with the female housing, and therefore is less liable to receive an influence of an external force, so that the half-fitting prevention connector with a high reliability can be obtained.

And besides, even if an external force acts on the lock arm to deform the same, the fitting between the connectors will not be released unless the slide lock is operated, and therefore the half-fitting prevention connector is more reliable.

What is claimed is:

1. A half-fitting prevention connector comprising:

a pair of female and male connectors fitted and connected together;

a resilient member, received in a front portion of a housing of said female connector, and urging said female and male connectors away from each other when said female and male connectors are in an incompletely-fitted condition;

a slide lock member, received in said housing, for retaining the male connector in said housing, said resilient member being positioned between said front portion of said housing and said slide lock member; and support means for slidably supporting said slide lock member in said housing, wherein when said female and male connectors are in said incompletely fitted condition, said resilient member urges said male connector, via said slide lock member, in a direction to separate said female and male connectors;

wherein said housing has a receiving space for receiving said slide lock member and said resilient member, and said receiving space is disposed close to a terminal receiving chamber for receiving a connection terminal, and said receiving space has an opening through which part of said slide lock member is exposed to an exterior; and wherein said slide lock member has a release projection which is pressed when releasing the connection between said female and male connectors.

2. A half-fitting prevention connector according to claim 1, wherein a housing of said male connector includes an elastic lock arm, and a housing lock for being retained by said slide lock member is formed on an upper surface of said lock arm, and half-fitting prevention locks are formed on and project from opposite sides of said lock arm, respectively, and said housing has half-fitting prevention lock stoppers formed at a front end portion of said receiving space.

3. A half-fitting prevention connector according to claim 2, in which the flexing of said lock arm during the fitting between the said female and male connectors is limited by said half-fitting prevention locks and said half-fitting prevention lock stoppers.

4. A half-fitting prevention connector comprising:

a pair of female and male connectors fitted and connected together;

a resilient member, received in a front portion of a housing of said female connector, and urging said female and male connectors away from each other when said female and male connectors are in an incompletely-fitted condition;

a slide lock member, received in said housing, for retaining the male connector in said housing, said resilient member being positioned between said front portion of said housing and said slide lock member; and support means for slidably supporting said slide lock member in said housing, wherein when said female and male connectors are in said incompletely fitted condition, said resilient member urges said male connector, via said slide lock member, in a direction to separate said female and male connectors;

wherein said housing has a receiving space for receiving said slide lock member and said resilient member, and said receiving space is disposed close to a terminal receiving chamber for receiving a connection terminal, and said receiving space has an opening through which part of said slide lock member is exposed to an exterior; and wherein a housing of said male connector includes an elastic lock arm, and a housing lock for being retained by said slide lock member is formed on an upper surface of said lock arm, and half-fitting prevention locks are formed on and projecting from on opposite sides of said lock arm, respectively, and said housing has half-fitting prevention lock stoppers formed at a front end portion of said receiving space, wherein upon partial insertion of said male connector, said prevention locks respectively abut against said lock stoppers to prevent deflection of said elastic lock arm.

5. A half-fitting prevention connector according to claim 4, in which the flexing of said lock arm during the fitting between the said female and male connectors is limited by said half-fitting prevention locks and said half-fitting prevention lock stoppers.

6. A half-fitting prevention connector, comprising a first connector housing having a cavity therein;

a second connector which is engageable with said first connector upon movement of said second connector in an insertion direction, said second connector having a flexible lock arm including a housing locking member;

a slide lock member which is slidably supported in said cavity of said first connector so as to be moveable between a locking position and an unlocking position, said slide lock member having a locking projection; and a biasing member for biasing said slide lock member in a opposite direction to said insertion direction, wherein when said second connector is moved in said insertion direction said slide lock member is moved thereby in said insertion direction against the force of said biasing member, wherein when said second connector is only partially engaged with said first connector, said biasing member, via said slide lock member, urges said second connector in said opposite direction and wherein when said second connector is completely inserted into said first cavity, said biasing member moves said slide lock member in said opposite direction to said locking position whereat said locking projection engages said housing locking member to lock said second connector to said first connector.

7. The connector of claim 6, wherein upon insertion of said second connector in said insertion direction, said housing locking member abuts against a rear side of said locking projection and wherein once said second connector is completely inserted, said housing locking member is deflected out of a path of movement of said locking projection in said opposite direction such that said locking member abuts against a front side of said housing locking projection.

8. The connector of claim 7, wherein a front side of said housing locking member is inclined.

* * * * *